US010924831B2

(12) United States Patent
Hanayama

(10) Patent No.: US 10,924,831 B2
(45) Date of Patent: Feb. 16, 2021

(54) SPEAKER DEVICE

(71) Applicant: Yamaha Corporation, Shizuoka (JP)

(72) Inventor: Katsutoki Hanayama, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/689,712

(22) Filed: Nov. 20, 2019

(65) Prior Publication Data

US 2020/0092624 A1 Mar. 19, 2020

Related U.S. Application Data

(63) Continuation of application No. PCT/JP2017/019688, filed on May 26, 2017.

(51) Int. Cl.

| | |
|---|---|
| ***H04R 1/02*** | (2006.01) |
| ***H04R 1/40*** | (2006.01) |
| ***H04R 3/12*** | (2006.01) |

(52) U.S. Cl.

CPC ..... *H04R 1/026* (2013.01); *H04R 1/025* (2013.01); *H04R 1/403* (2013.01); *H04R 3/12* (2013.01); *H04R 2201/025* (2013.01)

(58) Field of Classification Search

CPC ..... H04R 1/026; H04R 1/025; H04R 1/403; H04R 3/12; H04R 2201/025

See application file for complete search history.

(56) References Cited

U.S. PATENT DOCUMENTS

| | | | | |
|---|---|---|---|---|
| 5,758,852 | A * | 6/1998 | Martin | H04R 1/026 181/199 |
| 9,866,950 | B2 * | 1/2018 | Tracy | A61F 6/142 |
| 2003/0053648 | A1 * | 3/2003 | Jorgensen | H04R 3/12 381/355 |
| 2004/0213425 | A1 * | 10/2004 | Simidian, II | H04R 1/026 381/335 |
| 2006/0239470 | A1 * | 10/2006 | Ferrell | H04R 1/323 381/92 |
| 2008/0192964 | A1 | 8/2008 | Iwayama | |
| 2016/0021454 | A1 * | 1/2016 | Liang | H04R 1/403 381/333 |

(Continued)

FOREIGN PATENT DOCUMENTS

| | | | |
|---|---|---|---|
| JP | S57-60486 | U | 4/1982 |
| JP | H03143194 | A | 6/1991 |

(Continued)

OTHER PUBLICATIONS

International Search Report in PCT/JP2017/019688, dated Jul. 18, 2017.

*Primary Examiner* — Andrew L Sniezek
(74) *Attorney, Agent, or Firm* — Global IP Counselors, LLP

(57) ABSTRACT

A speaker device includes a first column speaker, a second column speaker and a speaker holder. The first column speaker has a first elongated housing and a plurality of first speaker units arranged in a row inside the first elongated housing. The second column speaker has a second elongated housing and a plurality of second speaker units arranged in a row inside the second elongated housing. The first and second speaker units have same frequency characteristics. The speaker holder connects the first and second column speakers together in parallel.

16 Claims, 11 Drawing Sheets

(56) References Cited

U.S. PATENT DOCUMENTS

| | | | | |
|---|---|---|---|---|
| 2018/0262836 | A1* | 9/2018 | Janes | H04R 1/26 |
| 2019/0052943 | A1* | 2/2019 | Huang | H04R 1/025 |
| 2019/0309939 | A1* | 10/2019 | Hand | F21S 8/061 |

FOREIGN PATENT DOCUMENTS

| | | | |
|---|---|---|---|
| JP | 2006020257 | A | 1/2006 |
| JP | 2006157857 | A | 6/2006 |
| JP | 2006191285 | A | 7/2006 |
| JP | 2007096839 | A | 4/2007 |
| JP | 2009124607 | A | 6/2009 |
| JP | 2013201614 | A | 10/2013 |

* cited by examiner

SPEAKER DEVICE

CROSS-REFERENCE TO RELATED APPLICATIONS

This application is a continuation application of International Application No. PCT/JP2017/019688, filed on May 26, 2017. The entire disclosure of International Application No. PCT/JP2017/019688 is hereby incorporated herein by reference.

BACKGROUND

Technical Field

The present invention relates to a speaker device.

Background Information

For example, as disclosed in Japanese Laid Open Patent Application No. 2006-191285, by arranging a plurality of speaker units having the same frequency characteristics in a row, it is possible to decrease a directivity angle in the direction in which the speaker units are arranged, that is, to decrease the spread of sound. This type of technique is used to suppress reflection on the floor and ceiling in order to reduce reverberation by arranging the speaker units in the vertical direction, when arranging a speaker device in a relatively large room, such as a gymnasium or a hall.

In view of such a method of use, a device called a column speaker, in which a plurality of speaker units are arranged inside an elongated housing, is commercially available. Since the intervals, etc., between the speaker units are optimized, such a column speaker can emit a sound wave having a relatively small directivity angle.

If the speaker device is installed in a corner of a room, it is possible to use the column speaker to reduce reverberation due to reflection on the floor and the ceiling by decreasing the directivity in the vertical direction, but reverberation may occur due to reflection on the wall.

SUMMARY

In light of the inconvenience described above, an object of this disclosure is to provide a speaker device having small directivity angles in the vertical direction and the horizontal direction.

A speaker device according to one aspect of this disclosure comprises a first column speaker, a second column speaker, and a speaker holder. The first column speaker has a first elongated housing and a plurality of first speaker units arranged in a row inside the first elongated housing. The second column speaker has a second elongated housing and a plurality of second speaker units arranged in a row inside the second elongated housing. The first and second speaker units have same frequency characteristics. The speaker holder connects the first and second column speakers together in parallel.

In the speaker device according to the aspect of this disclosure, the speaker holder include a connecting member coupled to back surfaces of the first and second elongated housings of the first and second column speakers, and a support member coupled to the connecting member.

In the speaker device according to the aspect of this disclosure, the speaker holder includes an angle adjustment joint coupled to the first and second column speakers. The angle adjustment joint has at least a first position and a second position in which a first sound wave emission direction of the first column speaker has a first orientation with respect to a second sound wave emission direction of the second column speaker while the angle adjustment joint is disposed in the first position, and in which the first sound wave emission direction of the first column speaker has a second orientation with respect to the second sound wave emission direction of the second column speaker while the angle adjustment joint is disposed in the second position, and the first orientation is different from the second orientation.

In the speaker device according to the aspect of this disclosure, the speaker holder includes a tilt angle adjustment joint coupled to the first and second column speakers. The tilt angle adjustment joint has at least a first position and a second position in which the first and second column speakers have a first inclination while the tilt angle adjustment joint is disposed in the first position and the speaker holder is mounted to a vertical support, and in which the first and second column speakers have a second inclination while the tilt angle adjustment joint is disposed in the second position and the speaker holder is mounted to the vertical support, and the first inclination is different from the second inclination.

The speaker device according to the aspect of this disclosure further comprises at least one additional speaker holder connecting the first and second column speakers together at a location spaced from the speaker holder.

In the speaker device according to the aspect of this disclosure, the support member of the speaker holder includes a tilt angle adjustment joint coupled to the first and second column speakers. The tilt angle adjustment joint has at least a first position and a second position in which the first and second column speakers have a first inclination while the tilt angle adjustment joint is disposed in the first position and the speaker holder is mounted to a vertical support, and in which the first and second column speakers have a second inclination while the tilt angle adjustment joint is disposed in the second position and the speaker holder is mounted to the vertical support, and the first inclination is different from the second inclination.

In the speaker device according to the aspect of this disclosure, the support member of the speaker holder includes a fixed member to be fixed to a vertical support, a first arm part movably coupled to the fixed member and a second arm part movably coupled to the connecting member, the first and second arm parts are movably coupled together between a first position in which the first and second column speakers have a first inclination and a second position in which the first and second column speakers have a second inclination, and the first inclination is different from the second inclination.

In the speaker device according to the aspect of this disclosure, the support member of the speaker holder further includes a fixing pin selectively coupled between the first and second arm parts at a first location to establish the first inclination and at a second location to establish the second inclination.

In the speaker device according to the aspect of this disclosure, the speaker holder includes a first connecting member coupled to a back surface of the first elongated housing of the first column speaker and a second connecting member coupled to a back surface of the second elongated housing of the second column speakers. The first and second connecting members are movably coupled together between a first position in which a first sound wave emission direction of the first column speaker has a first orientation with respect to a second sound wave emission direction of the second column speaker and a second position in which the first sound wave emission direction of the first column speaker has a second orientation with respect to the second sound wave emission direction of the second column speaker.

In the speaker device according to the aspect of this disclosure, the first and second connecting members are pivotally coupled together.

In the speaker device according to the aspect of this disclosure, the speaker holder includes a fixed member to be fixed to a vertical support, a first arm part movably coupled to the fixed member, and a second arm part movably coupled to the first and second connecting members. The first and second arm parts are movably coupled together between a first position in which the first and second column speakers have a first inclination and a second position in which the first and second column speakers have a second inclination, and the first inclination is different from the second inclination.

In the speaker device according to the aspect of this disclosure, the connecting member of the speaker holder includes an angle adjustment joint coupled to the first and second column speakers. The angle adjustment joint has at least a first position and a second position in which a first sound wave emission direction of the first column speaker has a first orientation with respect to a second sound wave emission direction of the second column speaker while the angle adjustment joint is disposed in the first position, and in which the first sound wave emission direction of the first column speaker has a second orientation with respect to the second sound wave emission direction of the second column speaker while the angle adjustment joint is disposed in the second position, and the first orientation is different from the second orientation.

In the speaker device according to the aspect of this disclosure, the speaker holder includes a directivity angle adjustment means for adjusting a relative angle of a sound wave emission direction between the first and second column speakers.

In the speaker device according to the aspect of this disclosure, the speaker holder includes an elevation/depression angle adjustment means for tilting the first and second column speakers in a longitudinal direction.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained in detail below, with reference to the drawings as appropriate. It will be apparent to those skilled from this disclosure that the following descriptions of the embodiments are provided for illustration only and not for the purpose of limiting the invention as defined by the appended claims and their equivalents.

First Embodiment

Figure 1:
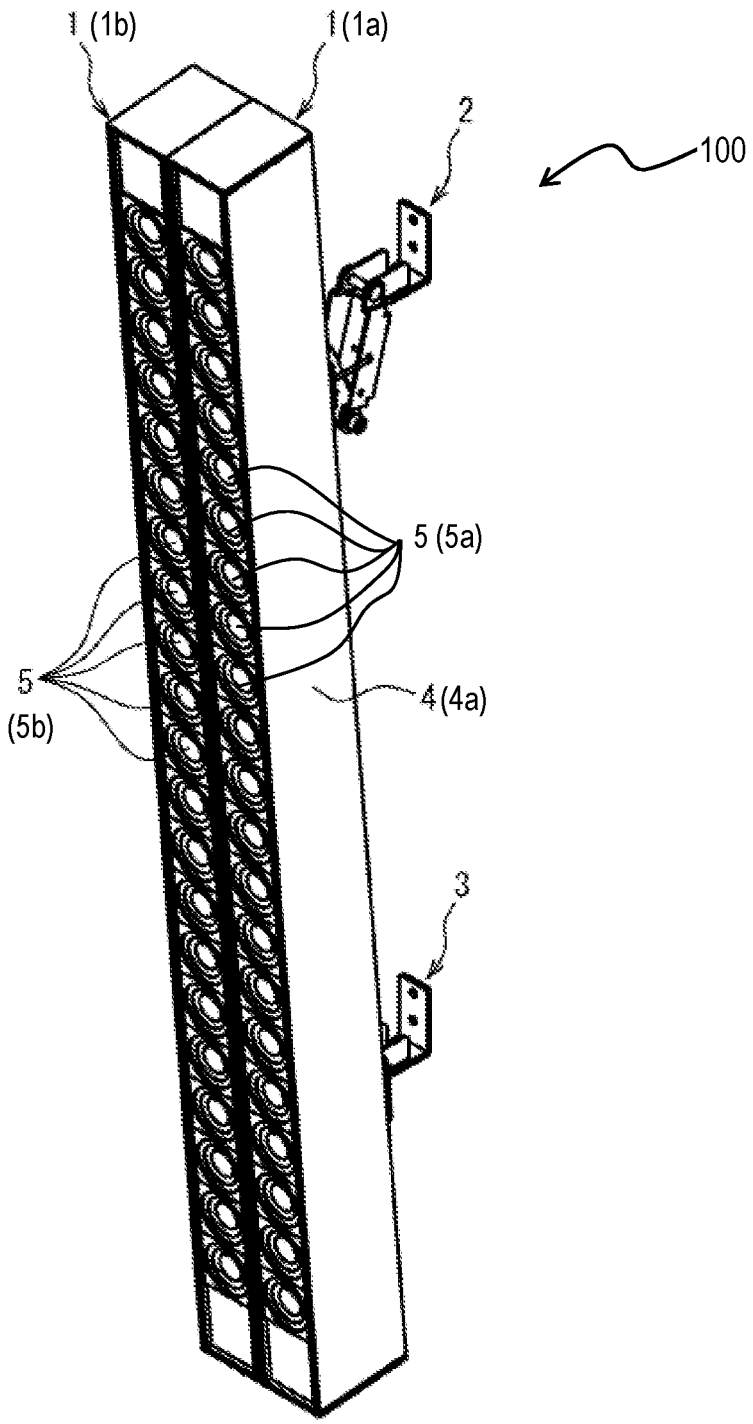
FIG. 1 is a front perspective view of a speaker device according to a first embodiment.
Figure 2:
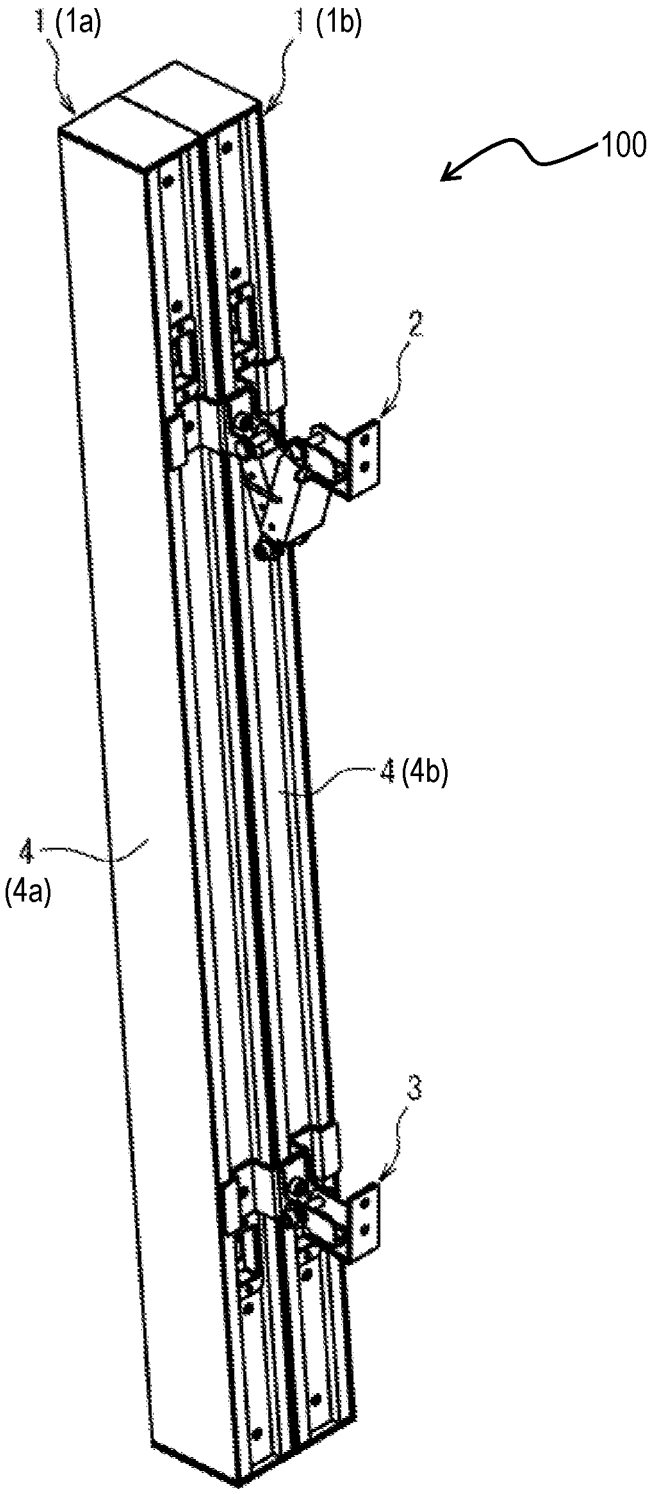
FIG. 2 is a rear perspective view of the speaker device of FIG. 1.

FIGS. 1 and 2 show a speaker device according to a first embodiment. The speaker device 100 has the same two column speakers 1 (1*a*, 1*b*), and a speaker holder connecting the two column speakers 1 together in parallel. As shown in FIGS. 1 and 2, the speaker device 100 includes an upper holder 2 (speaker holder) and a lower holder 3 (speaker holder, additional speaker holder) that connect these two column speakers 1 together in parallel. In the speaker device 100, the upper holder 2 and the lower holder 3 can be fixed to a vertical support such as a wall, a pillar, or the like so that the two column speakers 1 can be attached to a wall or the like.

Column Speaker

A first column speaker 1*a* has a first elongated housing 4*a* and a plurality of first speaker units 5*a* arranged in a row inside the first elongated housing 4*a*. A second column speaker 1*b* has a second elongated housing 4*b* and a plurality of second speaker units 5*b* arranged in a row inside the second elongated housing 4*b*. The first and second speaker units 5(5*a*, 5*b*) have same frequency characteristics.

In each of the first and second column speakers 1*a*, 1*b*, the directivity angle in the direction (longitudinal direction) in which the first speaker units 5*a* are arranged or the second speaker unit 5*b* are arranged is small (spread of sound is small). The speaker device 100 can suppress reverberation caused by reflection of sound waves on the floor and the ceiling by arranging the column speakers 1 vertically.

Commercially available products of the same type can be used as the two column speakers 1.

Upper Holder

Figure 3:
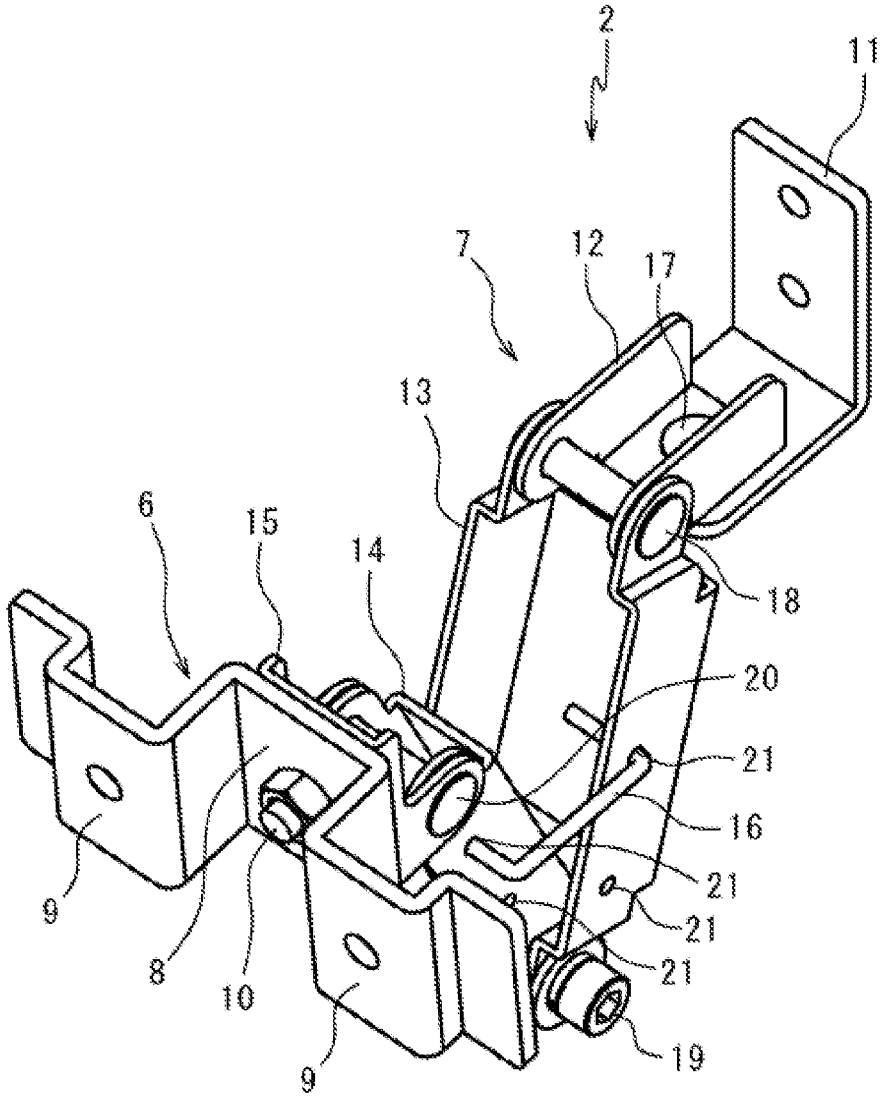
FIG. 3 is a perspective view of an upper holder of the speaker device of FIG. 1.

As shown in FIG. 3, the upper holder 2 (speaker holder) has a connecting member 6 coupled to back surfaces of the first and second elongated housings 4*a*, 4*b* of the first and second column speakers 1*a*, 1*b*, and an upper support member 7 (support member) coupled to the connecting member 6. The connecting member 6 is bridged across the backs of the two column speakers 1 (refer to FIG. 2) and the upper support member 7 supports the connecting member 6.

Connecting Member

The connecting member 6 can be formed by bending one sheet of metal plate. Specifically, the connecting member 6 has a central portion 8 that is held by the upper support member 7, and a pair of attaching portions 9 that are offset forward from this central portion 8, that are in close contact with the back surfaces of the first and second column speakers 1*a*, 1*b*, and that are fixed to the first and second column speakers 1*a*, 1*b* by means of screws, or the like, which are not shown.

Examples of the metal plate that forms the connecting member 6 include plated steel plates, stainless steel plates, and the like. The thickness of this metal plate is set to have a strength that can maintain the bent state, such as 2.5 mm or more and 4.0 mm or less.

In this manner, as a result of the connecting member 6 being formed from one metal plate, it is possible to accurately maintain the distance between the first and second column speakers 1*a*, 1*b*. In addition, because the pair of attaching portions 9 are offset forward from the central portion 8 in the connecting member 6, interference of a bolt & nut 10, used for attaching the central portion 8 to the upper support member 7, with the first and second column speakers 1*a*, 1*b* can be prevented.

Since the connecting member 6 connects the first and second column speakers 1*a*, 1*b* in parallel in the speaker device 100, sound waves emitted by the first and second column speakers 1*a*, 1*b* interfere with each other, and the directivity angle in the parallel direction decreases. Therefore, the speaker device 100 can suppress reverberation caused by reflection of sound waves on the wall when the first and second column speakers 1*a*, 1*b* are installed vertically in the corner of the room.

Upper Support Member

The upper support member 7 has an elevation/depression angle adjustment mechanism (elevation/depression angle adjustment means) for tilting the first and second column speakers 1*a*, 1*b* in the longitudinal direction. Specifically, the upper support member 7 has a fixed part 11 that is to be fixed to the wall, or the like, a swinging part 12 that is attached to the fixed part 11 so as to be swingable in the horizontal direction, a first arm part 13 that is attached to this swinging part 12 so as to be swingable in the vertical direction, a second arm part 14 that is attached to a distal end of this first arm part 13 so as to be swingable in the vertical direction, a connecting part 15 that is attached to the distal end of this second arm part 14 so as to be swingable in the vertical direction and that is connected to the central portion 8 of the connecting member 6, and a fixing pin 16 that sets the angle between the first arm part 13 and the second arm part 14.

The elevation/depression angle adjustment mechanism of the upper support member 7 adjusts the distance between the fixed part 11 and the connecting part 15 by swinging the first arm part 13 and the second arm part 14, and adjusts the inclination angle of the first and second column speakers 1*a*, 1*b* by moving the upper portion of the first and second column speakers 1*a*, 1*b* back and forth with respect to the lower portion, which is held by the lower holder 3.

The fixed part 11 can be formed by bending and shaping a strip-shaped metal plate into an L shape. Specifically, the fixed part 11 can be configured to have a vertical portion that is fixed to a vertical surface such as a wall by means of a screw, or the like, which is not shown, and a horizontal portion that extends in the horizontal direction from the lower end of this vertical portion and to which the swinging part 12 is attached.

Examples of the metal plate that forms the fixed part 11 include plated steel plates, stainless steel plates, and the like. The thickness of this metal plate is set to have a strength that can maintain the bent state, such as 2.5 mm or more and 4.0 mm or less.

The swinging part 12 can have a channel shape (shape having a bottom wall and a pair of side walls) that is formed by bending the two side edges of a metal plate. This swinging part 12 is attached to the fixed part 11 by means of, for example, a rivet 17, or the like, that penetrates the bottom wall of the swinging part 12 and the horizontal portion of the fixed part 11, so as to be swingable and such that the distal end of the rivet 17 protrudes from the fixed part 11.

Examples of the metal plate that forms the swinging part 12 include plated steel plates, stainless steel plates, and the like. The thickness of this metal plate is preferably smaller than the thickness of the metal plate that forms the fixed part 11 so as to allow ease of processing, such as 1.2 mm or more and 2.0 mm or less.

The first arm part 13 can have a channel shape that is formed by bending the two side edges of a metal plate. In this first arm part 13, the pair of side walls preferably protrude on both sides of the longitudinal direction of the bottom wall. In addition, in the pair of side walls of the first arm part 13, the projecting portions on both sides are bent and extend inwardly in a stepped manner, and the interval between the central portions is large so as to be capable of housing the second arm part 14.

In this first arm part 13, one end of the pair of side walls is attached to the distal end of the side walls of the swinging part 12 (on the opposite side of the side attached to the fixed part 11) by means of, for example, a rivet 18, or the like, that penetrates the pair of side walls of the first arm part 13 and the swinging part 12 so as to be swingable in the vertical direction.

The same metal plate that forms the swinging part 12 can be used as the metal plate that forms the first arm part 13.

The second arm part 14 can have a channel shape that is formed by bending the two side edges of a metal plate, and the pair of side walls preferably protrude on both sides of the longitudinal direction of the bottom wall. In this second arm part 14, one end of the pair of side walls is attached to the distal end of the pair of side walls of the first arm part 13 by means of, for example, a bolt & nut 19, or the like, that penetrates the pairs of side walls of the second arm part 14 and the first arm part 13 so as to be fixable as well as swingable in the vertical direction.

The same metal plate that forms the swinging part 12 can be used as the metal plate that forms the second arm part 14.

Because the second arm part 14 can be accommodated in the first arm part 13, it is possible to reduce the minimum distance between the fixed part 11 and the connecting part 15. As a result, the speaker device 100 can reduce the distance between the column speakers 1 and the wall, or the like, when disposing the column speakers 1 vertically.

The connecting part 15 can have a channel shape that is formed by bending the two side edges of a metal plate. In this connecting part 15, the pair of side walls is attached to the distal end of the pair of side walls of the second arm part 14 by means of, for example, a rivet 20, or the like, that penetrates the pairs of side walls of the connecting part 15 and the second arm part 14 so as to swingable in the vertical direction.

The same metal plate that forms the swinging part 12 can be used as the metal plate that forms the connecting part 15.

The fixing pin 16 is formed by bending both ends of a metal bar in the same direction at a substantially right angle.

By inserting the two ends into fixing holes 21 provided in the first arm part 13 and the second arm part 14, respectively, this fixing pin 16 fixes the relative angle between the first arm part 13 and the second arm part 14.

Examples of the metal bar that is used to form the fixing pin 16 include a piano wire, a hard steel wire, and the like. The diameter of the fixing pin 16 can be set to, for example, 2 mm or more and 3 mm or less. It is sufficient if the diameter of the fixing holes 21 of the first arm part 13 and the second arm part 14 into which the fixing pin 16 is inserted is larger than the diameter of the fixing pin 16. The difference between the diameter of each of the fixing holes 21 and the diameter of the fixing pin 16 is, for example, 0.3 mm or more and 1 mm or less.

The upper holder 2 includes a tilt angle adjustment joint coupled to the first and second column speakers 1*a*, 1*b*. More specifically, the upper support member 7 includes the tilt angle adjustment joint. The tilt angle adjustment joint has at least a first position (first tilt angle adjustment position) in which the first and second column speakers 1*a*, 1*b* have a first inclination while the tilt angle adjustment joint is disposed in the first position and the upper holder 2 is mounted to the vertical support, and a second position (second tilt angle adjustment position) in which the first and second column speakers 1*a*, 1*b* have a second inclination while the tilt angle adjustment joint is disposed in the second position and the upper holder 2 is mounted to the vertical support. The first inclination is different from the second inclination. In the embodiment, the upper support member 7 includes the tilt angle adjustment joint.

The tilt angle adjustment joint of the upper support member 7 of the upper holder 2 includes at least the first arm part 13 movably coupled to the fixed part 11 and the second arm part 14 movably coupled to the connecting member 6. The first and second arm parts 13, 14 are movably coupled together between a first position in which the first and second column speakers 1*a*, 1*b* have a first inclination and a second position in which the first and second column speakers 1*a*, 1*b* have a second inclination, and the first inclination is different from the second inclination.

The tilt angle adjustment joint of the upper support member 7 of the upper holder 2 further includes the fixing pin 16 selectively coupled between the first and second arm parts 13, 14 at a first location to establish the first inclination and at a second location to establish the second inclination.

Lower Holder

Figure 4:
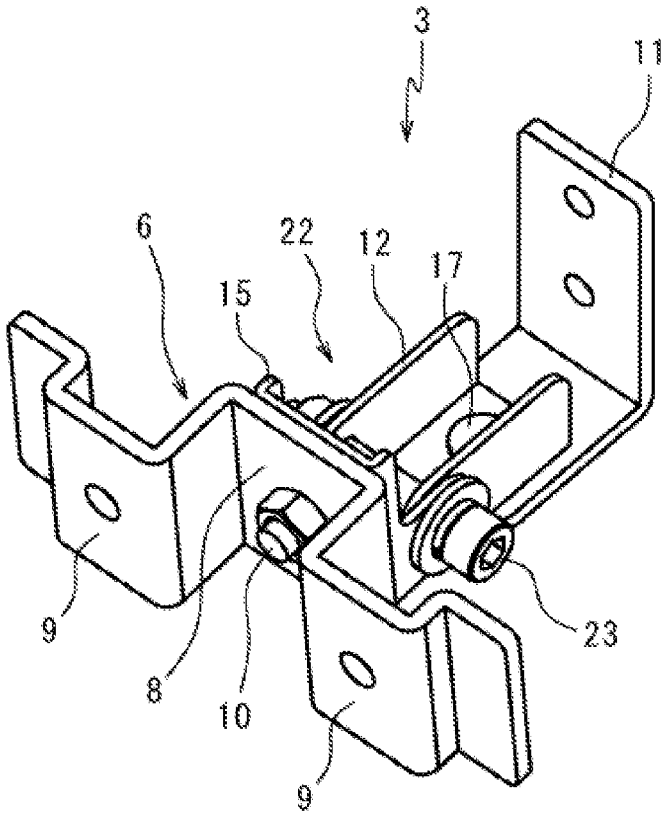
FIG. 4 is a perspective view of a lower holder of the speaker device of FIG. 1.

As shown in FIG. 4, the lower holder 3 (speaker holder, additional speaker holder) connects the first and second column speakers 1*a*, 1*b* together at a location spaced from the upper holder 2. The lower holder 3 has a connecting member 6 that is coupled to and bridged across the back surfaces of the first and second column speakers 1*a*, 1*b* (refer to FIG. 2) and a lower support member 22 (support member) that is coupled to and supports the connecting member 6.

The configuration of the connecting member 6 of the lower holder 3 can be the same as the configuration of the connecting member 6 of the upper holder 2. The connection between the connecting member 6 and the lower support member 22 can be achieved by a bolt & nut 10.

Lower Support Member

The lower support member 22 has a fixed part 11 that is to be fixed to the wall, or the like, a swinging part 12 that is attached to the fixed part 11 so as to be swingable in the horizontal direction, and a connecting part 15 that is attached to this swinging part 12 so as to be swingable in the vertical direction.

The configurations of the fixed part 11, the swinging part 12, and the connecting part 15 of the lower support member 22 can be the same as the configurations of the fixed part 11, the swinging part 12, and the connecting part 15 of the upper support member 7. That is, the lower support member 22 can be configured such that the first arm part 13 and the second arm part 14 of the upper support member 7 are omitted and the connecting part 15 is directly connected to the swinging part 12. The connection between the swinging part 12 and the connecting part 15 of the lower support member 22 can be achieved by using a bolt & nut 23 so as to facilitate attachment/detachment.

In the lower support member 22, the interval between the fixed part 11 and the connecting part 15 is fixed, and a rotational axis is set in the longitudinal direction of the first and second column speakers 1*a*, 1*b*. Specifically, the lower holder 3 holds the first and second column speakers 1*a*, 1*b* so as to be rotatable around the bolt & nut 23.

Since the speaker device 100 can be formed by connecting commercially available first and second column speakers 1*a*, 1*b* in parallel with the upper holder 2 and the lower holder 3, it can be provided relatively inexpensively, even if demand is small (even if the production volume is small).

Second Embodiment

Figure 5:
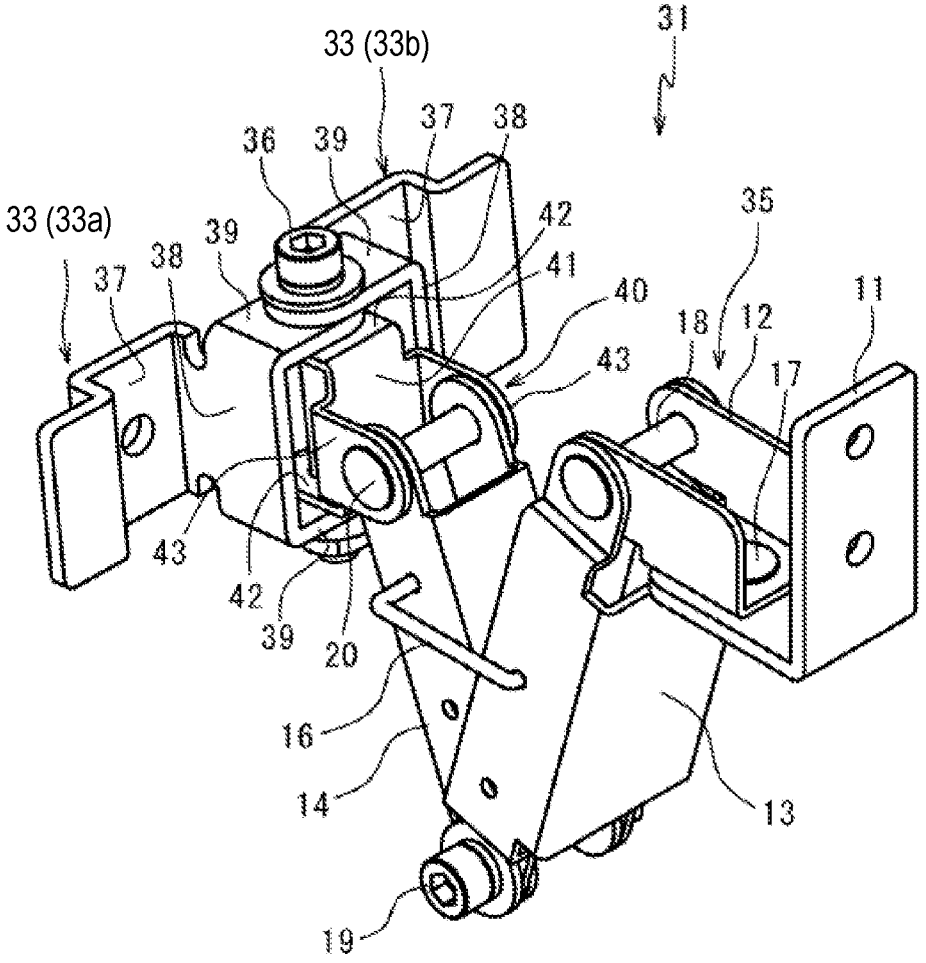
FIG. 5 is a perspective view of an upper holder of the speaker device according to a second embodiment.
Figure 6:
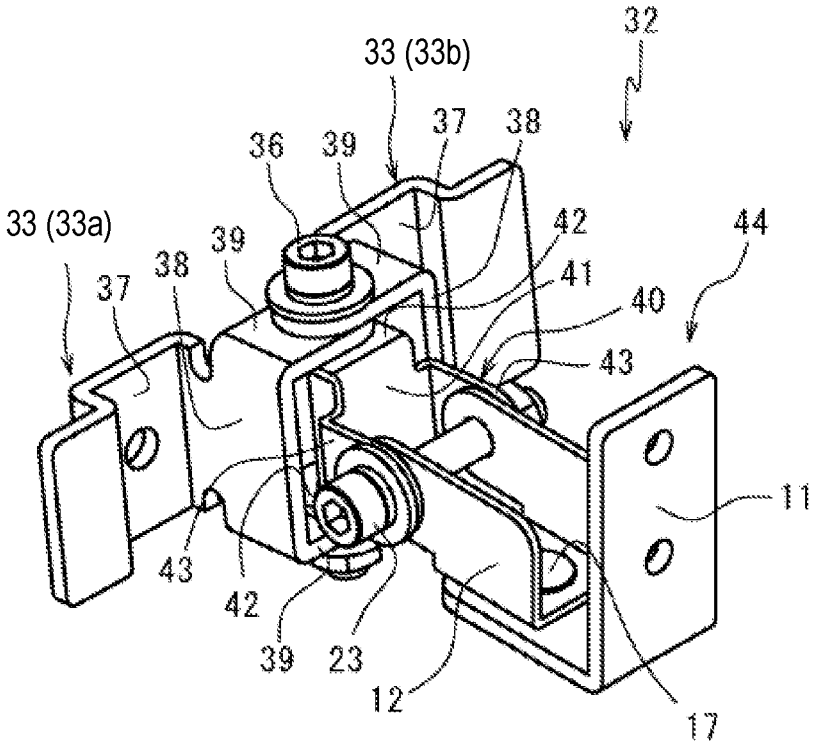
FIG. 6 is a perspective view of a lower holder used together with the upper holder of FIG. 5.

FIGS. 5 and 6 show an upper holder 31 (speaker holder) and a lower holder 32 (speaker holder, additional speaker holder) of the speaker device 100 according to a second embodiment. This upper holder 31 and the lower holder 32 can be used instead of the upper holder 2 and the lower holder 3 as shown in FIGS. 1 and 2. That is, the speaker device 100 according to the present embodiment is obtained by attaching the upper holder 31 and the lower holder 32 to the back surfaces of the first and second column speakers 1*a*, 1*b* of FIGS. 1 and 2. The upper holder 31 and the lower holder 32 connects the first and second column speakers 1*a*, 1*b* together in parallel.

Upper Holder

The upper holder 31 (speaker holder) has a directivity angle adjustment mechanism (directivity angle adjustment means) for adjusting the relative angle of the sound wave emission direction between the first and second column speakers 1*a*, 1*b*. Specifically, the upper holder 31 has a connection member 33 coupled to the back surfaces of the first and second elongated housings 4*a*, 4*b* of the first and second column speakers 1*a*, 1*b*, and an upper support member 35 (support member) coupled to the connecting member 33. The connection member 33 according to the second embodiment is a pair of first and second connecting members 33*a*, 33*b* that are respectively attached to the back surfaces of the first and second column speakers 1*a*, 1*b*. The upper support member 35 supports the pair of first and second connecting members 33*a*, 33*b* so as to be swingable in the lateral direction of the first and second column speakers 1*a*, 1*b*.

Connecting Member

The first and second connecting members 33*a*, 33*b* are connected to each other and attached to the upper support member 35 by means of a bolt & nut 36 so as to be swingable. In addition, the first and second connecting members 33*a*, 33*b* are fixed to the upper support member 35 and the relative angle therebetween is maintained by tightening the bolt & nut 36.

Each of the first and second connecting members 33*a*, 33*b* can be formed by bending one sheet of metal plate. Specifically, each of the first and second connecting members 33*a*, 33*b* has an attaching portion 37 that is fixed to each of the back surfaces of the first and second elongated housings 4*a*, 4*b* of the first and second column speakers 1*a*, 1*b*, an extending portion 38 that extends from this attaching portion 37 toward the upper support member 35, and a pair of connecting portions 39 that extend linearly in the lateral direction of the first and second column speakers 1*a*, 1*b* from the upper and lower ends of the extending portion 38 (side edges of the longitudinal direction of the first and second column speakers 1*a*, 1*b*) and into which the bolt & nut 36 are inserted.

Examples of the metal plate that forms each of the first and second connecting members 33*a*, 33*b* include plated steel plates, stainless steel plates, and the like. The thickness of this metal plate is set to have strength that can maintain the bent state, such as 2.5 mm or more and 4.0 mm or less.

The vertical height of the extending portion 38 of one of the first and second connecting members 33*a*, 33*b* is preferably greater than the vertical height of the extending portion 38 of the other of the first and second connecting members 33*a*, 33*b* such that the pair of connecting portions 39 of the other of the first and second connecting members 33*a*, 33*b* are disposed on the outer side of the pair of connecting portions 39 of the one of the first and second connecting members 33*a*, 33*b*. In the present embodiment, the vertical height of the extending portion 38 of the second connecting member 33*b* is greater than the vertical height of the extending portion 38 of the first connecting member 33*a*.

Upper Support Member

The upper support member 35 has a fixed part 11 that is to be fixed to the wall, or the like, a swinging part 12 that is attached to the fixed part 11 so as to be swingable in the horizontal direction, a first arm part 13 that is attached to this swinging part 12 so as to be swingable in the vertical direction, a second arm part 14 that is attached to a distal end of this first arm part 13 so as to be swingable in the vertical direction, a connecting part 40 that is attached to the distal end of this second arm part 14 so as to be swingable in the vertical direction and to which the first and second connecting members 33*a*, 33*b* are attached, and a fixing pin 16 that sets the angle between the first arm part 13 and the second arm part 14.

The configurations of the fixed part 11, the swinging part 12, the first arm part 13, the second arm part 14, and the fixing pin 16 of the upper support member 35 of the upper holder 31 of FIG. 5 can be the same as the configurations of the fixed part 11, the swinging part 12, the first arm part 13, the second arm part 14, and the fixing pin 16 of the upper support member 7 of the upper holder 2 of FIG. 3.

The connecting part 40 can be formed by bending two side edges of a metal plate. Specifically, the connecting part 40 has a base portion 41 that is disposed in parallel with the back surfaces of the first and second elongated housings 4*a*, 4*b* of the first and second column speakers 1*a*, 1*b*, a pair of first flaps 42 that are disposed inside the pair of connecting portions 39 of the first and second connecting members 33*a*, 33*b*, that extend from the upper and lower edges of this base portion 41 toward a side of the column speakers 1, and through which the bolt & nut 36 penetrates, and a pair of second flaps 43 that are attached to the distal end portions of the pair of side walls of the second arm part 14 and extend toward the opposite side of the column speakers 1 from the left and right edges of the base portion 41 (edges in the lateral direction of the column speaker 1) so as to be swingable in the vertical direction.

The same metal plate that forms the swinging part 12 can be used as the metal plate that forms the connecting part 40.

Lower Holder

The lower holder 32 (speaker holder, additional speaker holder) connects the first and second column speakers 1*a*, 1*b* together at a location spaced from the upper holder 31. The lower holder 32 has the first connecting member 33 coupled to the back surfaces of the first and second elongated housings 4*a*, 4*b* of the first and second column speakers 1*a*, 1*b*, and a lower support member 44 (support member) coupled to the connecting member 33. In the second embodiment, the connecting member 33 of the lower holder 32 is a pair of first and second connecting members 33*a*, 33*b* that are respectively attached to the back surfaces of the first and second elongated housings 4*a*, 4*b* of the first and second column speakers 1*a*, 1*b*. The lower support member 44 supports the pair of first and second connecting members 33*a*, 33*b* so as to be swingable in the lateral direction of the first and second column speakers 1*a*, 1*b*.

The configuration of the first and second connecting members 33*a*, 33*b* of the lower holder 32 can be the same as the configuration of the first and second connecting members 33*a*, 33*b* of the upper holder 31. The connection between the first and second connecting members 33*a*, 33*b* and the lower support member 44 can be achieved by a bolt & nut 36.

Lower Support Member

The lower support member 44 has a fixed part 11 that is to be fixed to the wall, or the like, a swinging part 12 that is attached to the fixed part 11 so as to be swingable in the horizontal direction, and a connecting part 40 that is attached to this swinging part 12 so as to be swingable in the vertical direction.

The configurations of the fixed part 11, the swinging part 12, and the connecting part 40 of the lower support member 44 can be the same as the configurations of the fixed part 11, the swinging part 12, and the connecting part 40 of the upper support member 35. That is, the lower support member 44 can be configured such that the first arm part 13 and the second arm part 14 of the upper support member 35 are omitted and the connecting part 40 is directly connected to the swinging part 12. The connection between the swinging part 12 and the connecting part 40 of the lower support member 44 can be achieved by using the bolt & nut 23 so as to facilitate attachment/detachment.

In the lower support member 44, the interval between the fixed part 11 and the connecting part 40 is fixed, and a rotational axis is set in the longitudinal direction of the first and second column speakers 1*a*, 1*b*. Specifically, the lower holder 32 holds the first and second column speakers 1*a*, 1*b* so as to be rotatable around the bolt & nut 23.

In the speaker device 100, the first and second connecting members 33*a*, 33*b* of the lower holder 32 and the first and second connecting members 33*a*, 33*b* of the upper holder 31 can independently swing around an axis that is parallel to the longitudinal direction of the first and second column speakers 1*a*, 1*b*. For this reason, the speaker device 100 can provide any angular difference in the sound wave emission direction of the first and second column speakers 1*a*, 1*b*. As a result, it is possible to adjust the degree of interference of the sound waves emitted from the first and second column speakers 1*a*, 1*b*, and to finely adjust the directivity angle of the speaker device 100.

Figure 7:
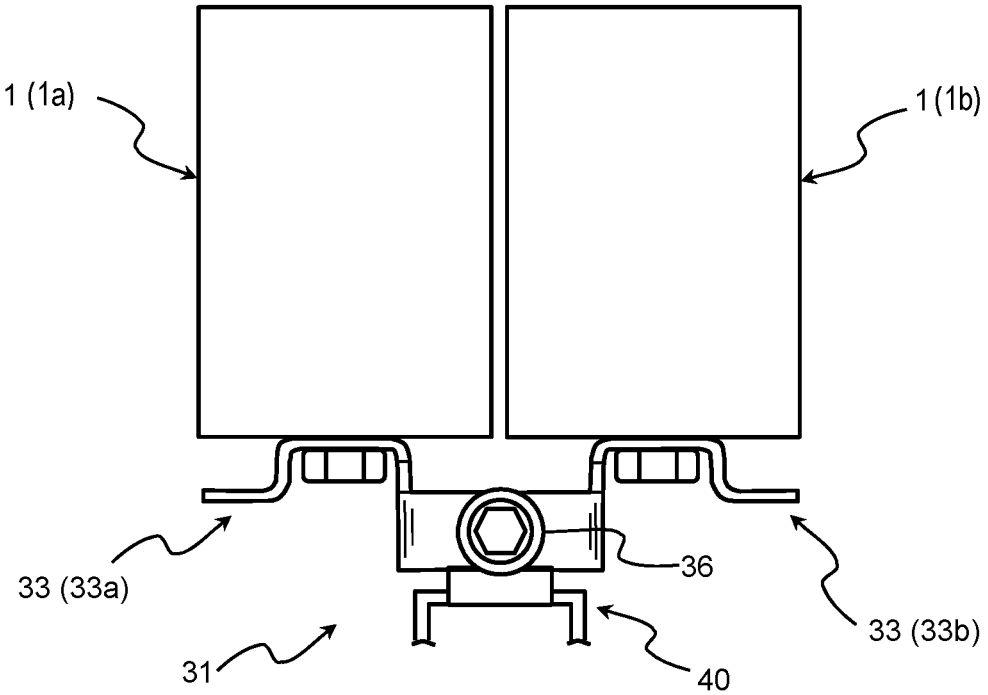
FIG. 7 is a top partial view of the speaker device according to the second embodiment in which an angle adjustment joint has a first position.
Figure 8:
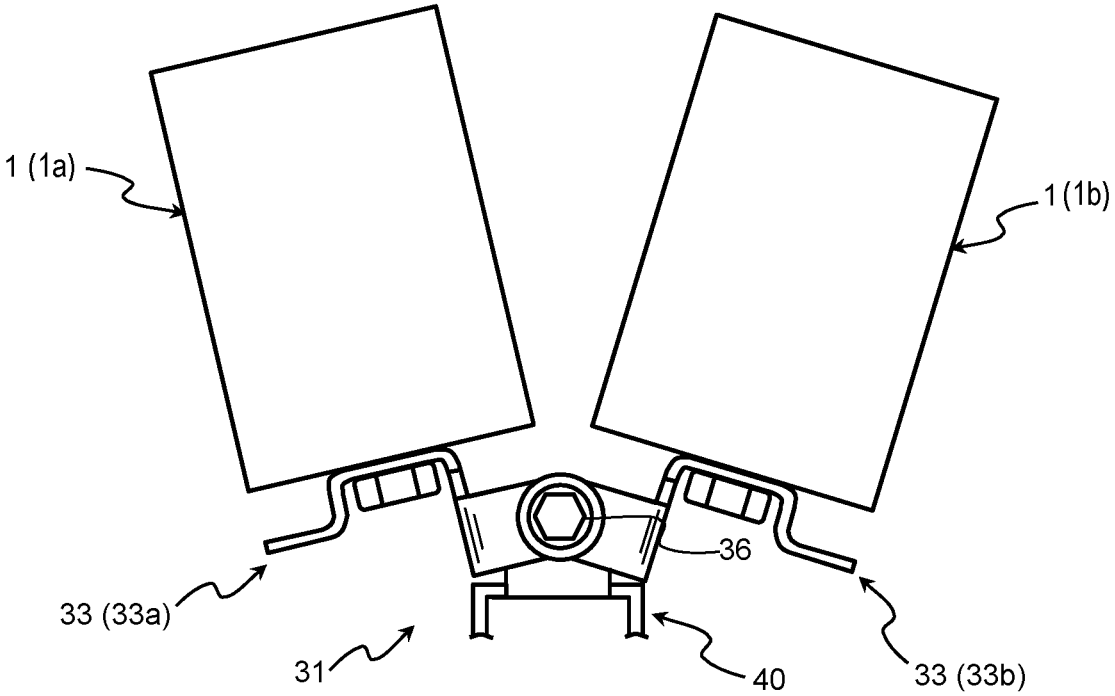
FIG. 8 is a top partial view of the speaker device according to the second embodiment in which the angle adjustment joint has a second position.

The upper holder 31 (speaker holder) includes an angle adjustment joint coupled to the first and second column speakers 1*a*, 1*b*. More specifically, the connecting member 33 includes the angle adjustment joint. The angle adjustment joint has at least a first position and a second position as shown in FIGS. 7 and 8. As shown in FIG. 7, the first position is a position in which a first sound wave emission direction of the first column speaker 1*a* has a first orientation with respect to a second sound wave emission direction of the second column speaker 1*b* while the angle adjustment joint is disposed in the first position. As shown in FIG. 8, the second position is a position in which the first sound wave emission direction of the first column speaker 1*a* has a second orientation with respect to the second sound wave emission direction of the second column speaker 1*b* while the angle adjustment joint is disposed in the second position. The first orientation is different from the second orientation. The first and second positions are not limited to the positions as shown in FIGS. 7 and 8, as long as the second orientation is different from the first orientation. For example, the angle adjustment joint has a position in which the first sound wave emission direction of the first column speaker 1*a* is the same as that of the first column speaker 1*a* as shown in FIG. 7 and the second sound wave emission direction of the second column speaker 1*b* is the same as that of the second column speaker 1*b* as shown in FIG. 8. Also, the angle adjustment joint has a position in which the first sound wave emission direction of the first column speaker 1*a* is the same as that of the first column speaker 1*a* as shown in FIG. 8 and the second sound wave emission direction of the second column speaker 1*b* is the same as that of the second column speaker 1*b* as shown in FIG. 7. Moreover, the angle adjustment joint has a position in which the rear ends of the side surfaces of the first and second column speakers 1*a*, 1*b* are disposed in close contact and a gap is formed between the front ends of the side surfaces of the first and second column speakers 1*a*, 1*b*.

The upper holder 31 (speaker holder) includes a first connecting member 33*a* coupled to the back surface of the first elongated housing 4*a* of the first column speaker 1*a* and a second connecting member 33*b* coupled to the back surface of the second elongated housing 4*b* of the second column speakers 1*b*. More specifically, the angle adjustment joint includes at least the first connecting member 33*a* and the second connecting member 33*b*. The first and second connecting members 33*a*, 33*b* are movably coupled together between the first position in which a first sound wave emission direction of the first column speaker 1*a* has a first orientation with respect to a second sound wave emission direction of the second column speaker 1*b* as shown in, for example, FIG. 7 and a second position in which the first sound wave emission direction of the first column speaker 1*a* has a second orientation with respect to the second sound wave emission direction of the second column speaker 1*b*, as shown in, for example, in FIG. 8.

The first and second connecting members 33*a*, 33*b* are pivotally coupled together. The first arm part 13 is movably coupled to the fixed member 11, and the second arm part is movably coupled to the first and second connecting members 33*a*, 33*b*.

In the speaker device 100 according to this disclosure, the directivity angles in the vertical direction and the horizontal direction are small.

Other Embodiments

The above-described embodiment does not limit the configuration of this disclosure. Therefore, in the above-described embodiment, the compositional elements of each part of the embodiment can be omitted, replaced, or added based on the recitation of the present Specification and common knowledge in the art, all of which shall be interpreted as belonging to the scope of this disclosure.

The speaker device 100 can include three or more column speakers in parallel.

In addition, the speaker device 100 can be attached to the wall, or the like, while connecting a plurality of the column speakers using one holder.

Examples

This disclosure will be described in detail below based on examples. However this disclosure is not to be interpreted to be limited by the description of these examples.

A prototype of a speaker device 100 was produced, in which the first and second column speakers 1*a*, 1*b* are connected, the arrangement direction of the speaker units 5 (5*a*, 5*b*)(longitudinal direction) was arranged vertically, and the frequency characteristics of the sound pressure level were measured at sound receiving positions having different inclination angles in the lateral direction (horizontal direction) with respect to the front of the sound wave emission direction in order to calculate the directivity angle of the speaker device 100.

Figure 9:
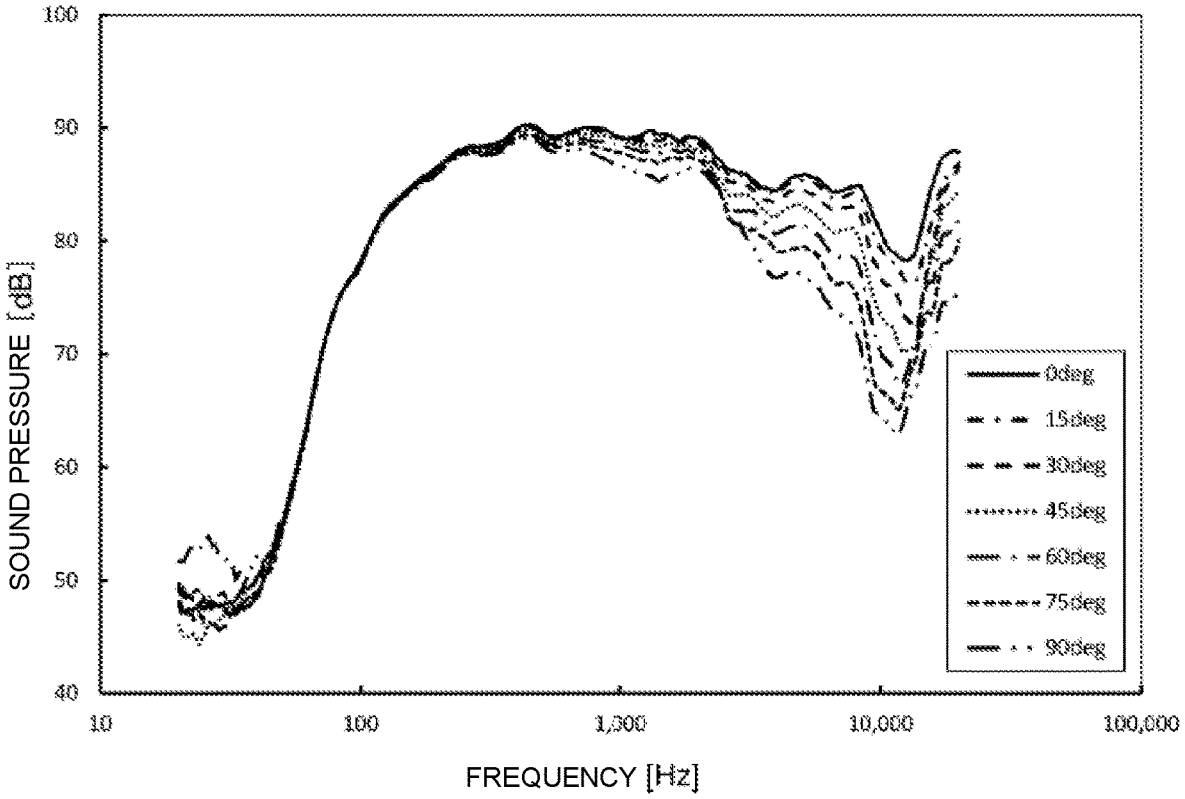
FIG. 9 is a graph showing frequency characteristics of a sound pressure level for each sound receiving angle of a single column speaker.

First, FIG. 9 shows the result of measuring the frequency characteristics for each sound receiving position of the column speaker alone used in the speaker device 100. From these measurement results, the angles of the sound receiving positions at which the sound pressure level decreased by 6 dB from the sound pressure level at the front of the sound wave emission direction were extracted at 1000 Hz, 1250 Hz, 1600 Hz, 2000 Hz, 2500 Hz, 3150 Hz, and 4000 Hz, respectively, and twice the average of these angles was calculated as a nominal directivity angle. As a result, the directivity angle when using the column speaker alone was 177°.

Figure 10:
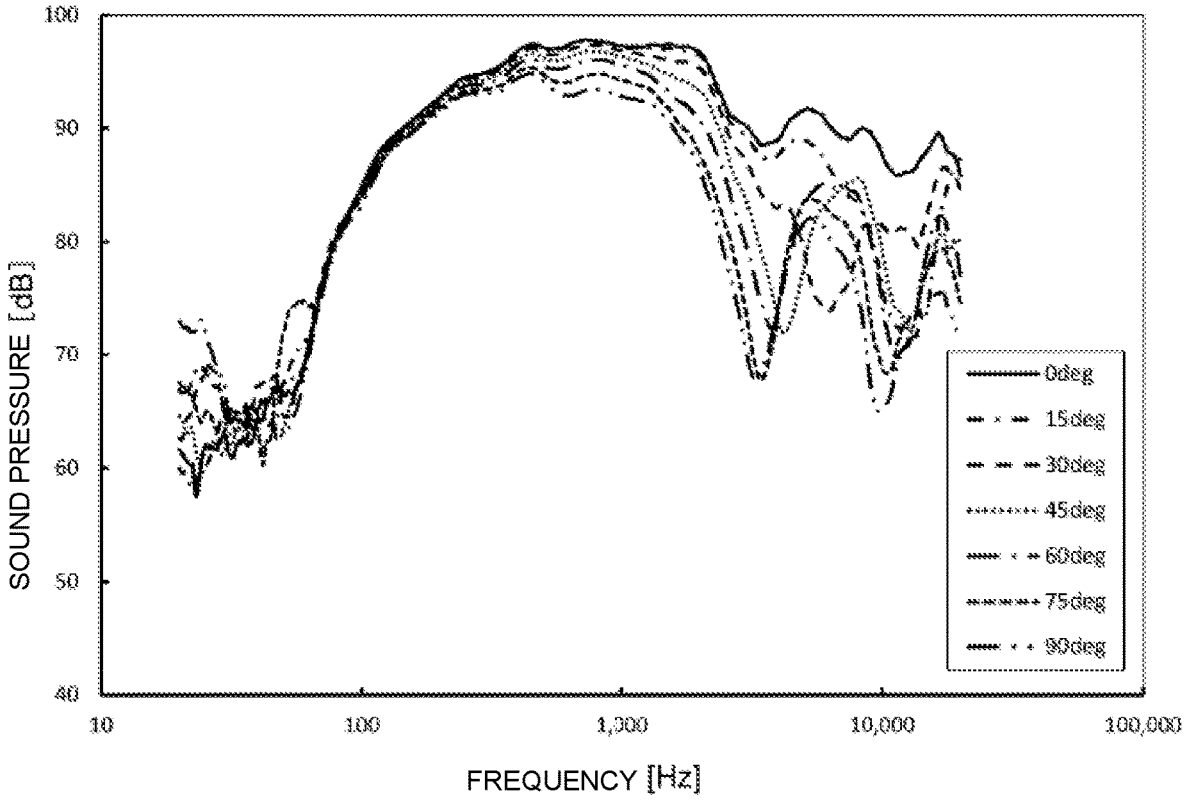
FIG. 10 is a graph showing frequency characteristics of a sound pressure level for each sound receiving angle in an experimental example of the speaker device.

FIG. 10 shows the result of measuring the frequency characteristics for each sound receiving position of the speaker device 100 in which the side surfaces of the first and second column speakers 1*a*, 1*b* are brought into close contact and connected to each other such that the sound wave emission directions are parallel to each other. The nominal directivity angle calculated from this measurement result was 124°.

Figure 11:
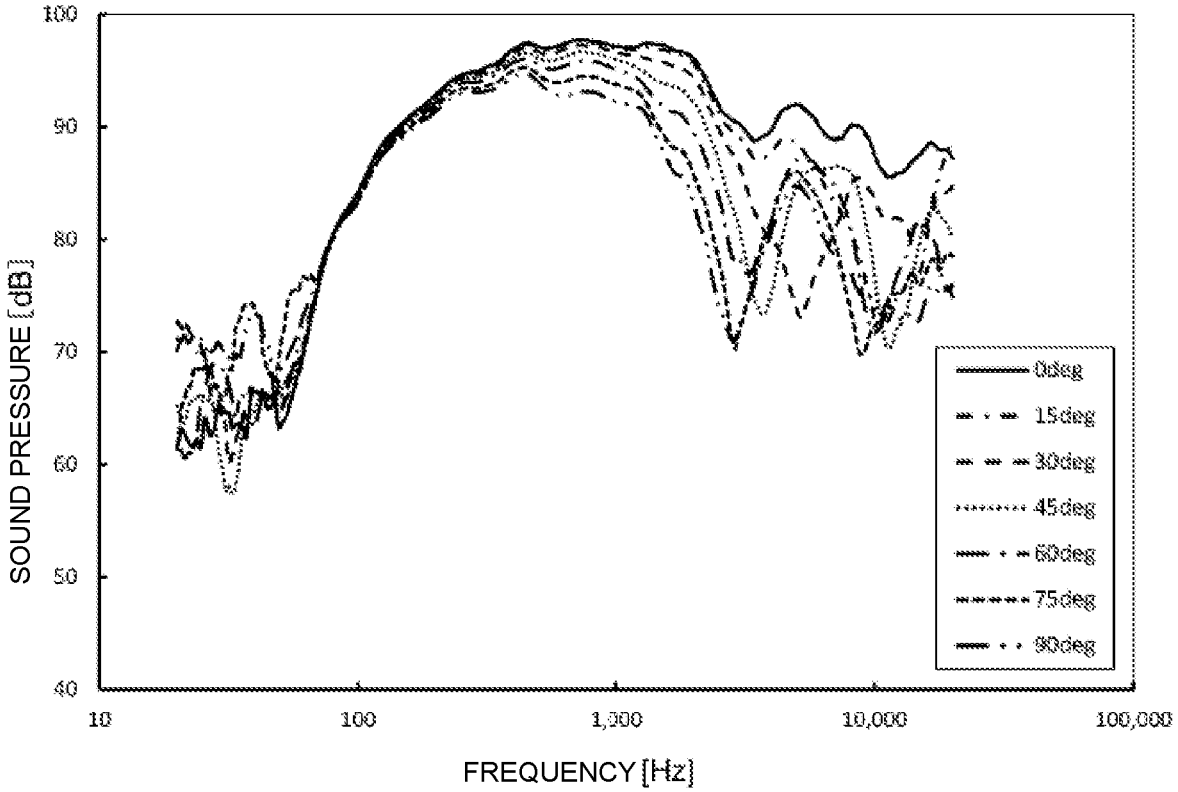
FIG. 11 is a graph showing frequency characteristics of a sound pressure level for each sound receiving angle in an experimental example of the speaker device that is different from that shown in FIG. 10.

FIG. 11 shows the result of measuring the frequency characteristics for each sound receiving position of the speaker device 100 in which the rear ends of the side surfaces of the first and second column speakers 1*a*, 1*b* are disposed in close contact such that a gap is formed between the front ends thereof, and connected such that the relative angle in the sound wave emission directions becomes 8°. The nominal directivity angle calculated from this measurement result was 119°.

Figure 12:
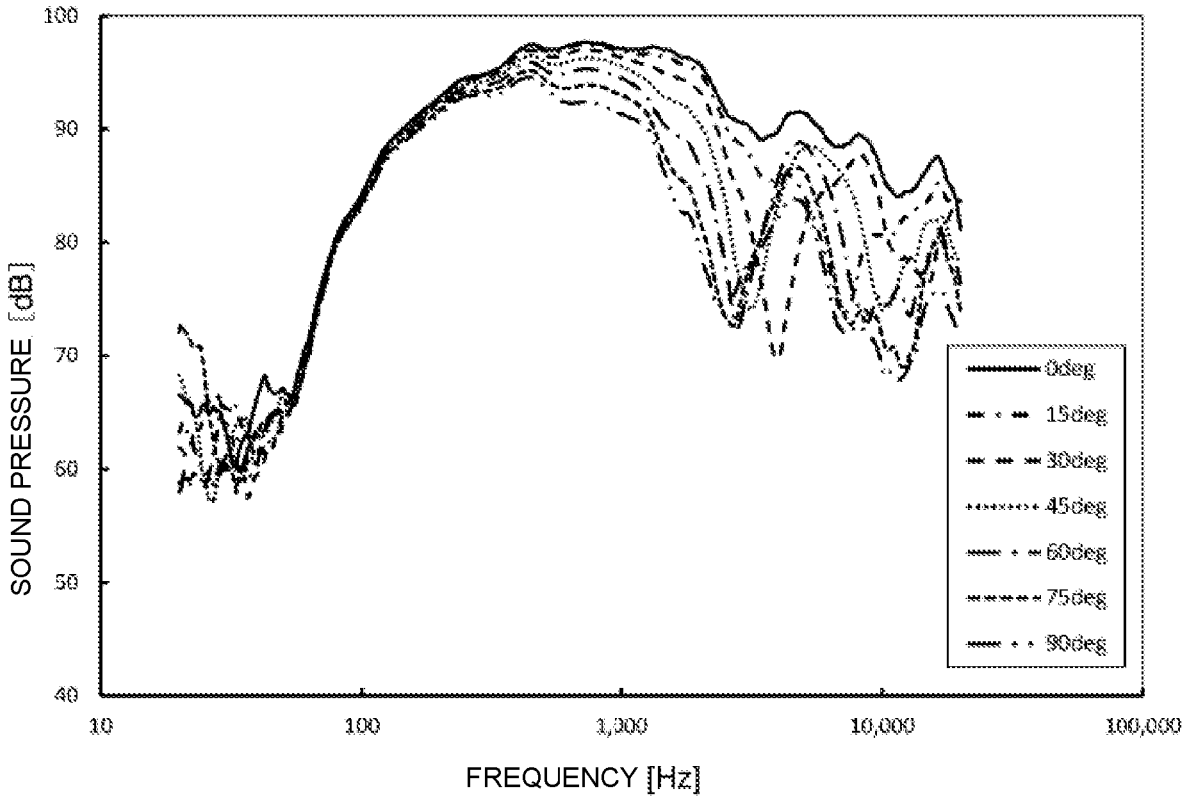
FIG. 12 is a graph showing frequency characteristics of a sound pressure level for each sound receiving angle in an experimental example of the speaker device that is different from those shown in FIGS. 10 and 11.

FIG. 12 shows the result of measuring the frequency characteristics for each sound receiving position of the speaker device 100 in which the rear ends of the side surfaces of the first and second column speakers 1*a*, 1*b* are disposed in close contact such that a gap is formed between the front ends thereof, and connected such that the relative angle in the sound wave emission directions becomes 16°. The nominal directivity angle calculated from this measurement result was 102°.

As described above, it was confirmed that, with the speaker device 100 according to this disclosure, it is possible to decrease the directivity angle compared to a case in which one column speaker is used. It was also confirmed that the directivity angle can be more finely adjusted by adjusting the relative angle of the two column speakers in the sound wave emission direction in the speaker device 100 according to this disclosure.

The speaker device according to this disclosure can be particularly suitable for use as a speaker device installed in a corner of a room.

Preferred Aspects

Preferred aspects that can be ascertained from the specific embodiments exemplified above are illustrated below.

A speaker device according to one aspect of this disclosure, which solves the problem described above, comprises a plurality of same column speakers, each having an elongated housing and a plurality of speaker units having the same frequency characteristics, which are arranged in a row inside this housing, and a holder that connects the plurality of column speakers in parallel.

In the speaker device according to the aspect of this disclosure, the holder can include a connecting member that is bridged across the back surfaces of the plurality of column speakers, and a support member that supports the connecting member.

In the speaker device according to the aspect of this disclosure, the holder can have a directivity angle adjustment mechanism for adjusting the relative angle of the sound wave emission direction between the plurality of column speakers.

In the speaker device according to the aspect of this disclosure, the holder can have an elevation/depression angle adjustment mechanism for tilting the plurality of column speakers in the longitudinal direction.

The speaker device according to the aspect of this disclosure can be provided with a plurality of the holders.

What is claimed is:

1. A speaker device, comprising:

a first column speaker having a first elongated housing and a plurality of first speaker units arranged in a row inside the first elongated housing, the first elongated housing having a first back wall that covers and extends across the plurality of first speaker units and that has a first outer surface that faces in an opposite direction of a first sound wave emission direction of the first column speaker;

a second column speaker having a second elongated housing and a plurality of second speaker units arranged in a row inside the second elongated housing, the second elongated housing having a second back wall that covers and extends across the plurality of second speaker units and that has a second outer surface that faces in an opposite direction of a second sound wave emission direction of the second column speaker, the first and second speaker units having same frequency characteristics; and a speaker holder connecting the first and second column speakers together in parallel, the speaker holder including a connecting member that has a pair of attaching portions directly contacted and coupled to the first and second outer surfaces of the first and second back walls and that has a central portion that is disposed between the attaching portions and is offset from the pair of attaching portions such that the central portion is spaced apart from the first and second outer surfaces of the first and second back walls, and a support member directly contacted and coupled to the central portion of the connecting member.

2. The speaker device according to claim 1, wherein the support member includes a tilt angle adjustment joint, the tilt angle adjustment joint has at least a first position and a second position in which the first and second column speakers have a first inclination while the tilt angle adjustment joint is disposed in the first position and the speaker holder is mounted to a vertical support, and in which the first and second column speakers have a second inclination while the tilt angle adjustment joint is disposed in the second position and the speaker holder is mounted to the vertical support, and the first inclination is different from the second inclination.

3. The speaker device according to claim 1, further comprising at least one additional speaker holder connecting the first and second column speakers together at a location spaced from the speaker holder.

4. The speaker device according to claim 1, wherein the support member of the speaker holder includes a fixed member to be fixed to a vertical support, a first arm part movably coupled to the fixed member, and a second arm part movably coupled to the central portion, the first and second arm parts are movably coupled together between a first position in which the first and second column speakers have a first inclination and a second position in which the first and second column speakers have a second inclination, and the first inclination is different from the second inclination.

5. The speaker device according to claim 4, wherein the support member of the speaker holder further includes a fixing pin selectively coupled between the first and second arm parts at a first location to establish the first inclination and at a second location to establish the second inclination.

6. The speaker device according to claim 1, wherein the speaker holder includes an elevation/depression angle adjustment means for tilting the first and second column speakers in a longitudinal direction.

7. A speaker device, comprising:

a first column speaker having a first elongated housing and a plurality of first speaker units arranged in a row inside the first elongated housing, the first elongated housing having a first back wall that covers and extends across the plurality of first speaker units and that has a first outer surface that faces in an opposite direction of a first sound wave emission direction of the first column speaker;

a second column speaker having a second elongated housing and a plurality of second speaker units arranged in a row inside the second elongated housing, the second elongated housing having a second back wall that covers and extends across the plurality of second speaker units and that has a second outer surface that faces in an opposite direction of a second sound wave emission direction of the second column speaker, the first and second speaker units having same frequency characteristics; and a speaker holder connecting the first and second column speakers together in parallel, the speaker holder including a first connecting member that has a first attaching portion directly contacted and coupled to the first outer surface of the first back wall and that has a first connecting portion that is offset from the first attaching portion such that the first connecting portion is spaced apart from the first outer surface of the first back wall, a second connecting member that has a second attaching portion directly contacted and coupled to the second outer surface of the second back wall and that has a second connecting portion that is offset from the second attaching portion such that the second connecting portion is spaced apart from the second outer surface of the second back wall, the first and second connecting portions being disposed between the first and second attaching portions, and a support member coupled to the first and second connecting portions of the first and second connecting members and directly contacted to one of the first and second connecting portions of the first and second connecting members.

8. The speaker device according to claim 7, wherein the first and second connecting members are pivotally coupled together.

9. The speaker device according to claim 7, wherein the support member includes a fixed member to be fixed to a vertical support, a first arm part movably coupled to the fixed member, and a second arm part movably coupled to the first and second connecting portions, the first and second arm parts are movably coupled together between a first tilt angle adjustment position in which the first and second column speakers have a first inclination and a second tilt angle adjustment position in which the first and second column speakers have a second inclination, and the first inclination is different from the second inclination.

10. The speaker device according to claim 9, wherein the support member of the speaker holder further includes a fixing pin selectively coupled between the first and second arm parts at a first location to establish the first inclination and at a second location to establish the second inclination.

11. The speaker device according to claim 7, wherein the first and second connecting members of the speaker holder form an angle adjustment joint that has at least a first position and a second position in which the first sound wave emission direction of the first column speaker has a first orientation with respect to the second sound wave emission direction of the second column speaker while the angle adjustment joint is disposed in the first position, and in which the first sound wave emission direction of the first column speaker has a second orientation with respect to the second sound wave emission direction of the second column speaker while the angle adjustment joint is disposed in the second position, and the first orientation is different from the second orientation.

12. The speaker device according to claim 7, wherein the support member includes a tilt angle adjustment joint, the tilt angle adjustment joint has at least a first tilt angle adjustment position and a second tilt angle adjustment position in which the first and second column speakers have a first inclination while the tilt angle adjustment joint is disposed in a first position and the speaker holder is mounted to a vertical support, and in which the first and second column speakers have a second inclination while the tilt angle adjustment joint is disposed in a second position and the speaker holder is mounted to the vertical support, and the first inclination is different from the second inclination.

13. The speaker device according to claim 7, wherein the speaker holder includes a directivity angle adjustment means for adjusting a relative angle of a sound wave emission direction between the first and second column speakers.

14. The speaker device according to claim 13, wherein the speaker holder includes an elevation/depression angle adjustment means for tilting the first and second column speakers in a longitudinal direction.

15. The speaker device according to claim 7, wherein the first and second connecting members are movably coupled together between a first position in which the first sound wave emission direction of the first column speaker has a first orientation with respect to the second sound wave emission direction of the second column speaker and a second position in which the first sound wave emission direction of the first column speaker has a second orientation with respect to the second sound wave emission direction of the second column speaker.

16. The speaker device according to claim 7, further comprising at least one additional speaker holder connecting the first and second column speakers together at a location spaced from the speaker holder.

* * * * *